United States Patent [19]

Besemann

[11] Patent Number: 4,878,659

[45] Date of Patent: Nov. 7, 1989

[54] METHOD OF AND APPARATUS FOR GATHERING AND MANIPULATING STACKS OF PAPER SHEETS AND THE LIKE

[75] Inventor: Alfred Besemann, Hamburg, Fed. Rep. of Germany

[73] Assignee: E.C.H. Will GmbH, Hamburg, Fed. Rep. of Germany

[21] Appl. No.: 131,369

[22] Filed: Dec. 10, 1987

[30] Foreign Application Priority Data

Dec. 11, 1986 [DE] Fed. Rep. of Germany ..... 3642259

[51] Int. Cl.[4] ..... B65H 31/12

[52] U.S. Cl. ..... 271/218; 414/790.1; 414/790.3; 414/790.8

[58] Field of Search ..... 414/43, 45, 46, 50, 414/97, 98, 36, 35, 29, 114, 115, 116, 131, 903, 790, 790.1, 790.3, 790.8; 271/207, 210, 211, 218

[56] References Cited

U.S. PATENT DOCUMENTS 3,580,402 5/1971 Tolf ..... 414/46 X
4,436,472 3/1984 Kunzmann ..... 271/218 X
4,484,501 11/1984 Ramcke ..... 83/255
4,508,333 4/1985 Byrt ..... 271/218
4,551,053 11/1985 Ishibashi ..... 414/114

*Primary Examiner*—Joseph J. Rolla
*Assistant Examiner*—David H. Bollinger
*Attorney, Agent, or Firm*—Peter K. Kontler

[57] ABSTRACT

Successive stacks of paper sheets are gathered from successive sheets of a stream of sheets at a first station where the sheets are fed downwardly to form a lowermost stack on mobile belt conveyors mounted on a reciprocable carriage, and a growing stack on top of the lowermost stack. When the growing stack is converted into a fully grown stack, the lowermost stack is transferred by the conveyors to a processing station and the fully grown stack is lowered to the level of the removed stack. The underside of each stack which is being removed from the first station is in large-area contact with the belt conveyors, and the front marginal portion of the stack which is being transported away from the first station is engaged and held by a jaw which is movable up and down as well as with the belt conveyors during the initial stage of removal of a stack from the first station to thus reduce the likelihood of shifting of sheets in the stack relative to each other.

37 Claims, 6 Drawing Sheets

Fig.6
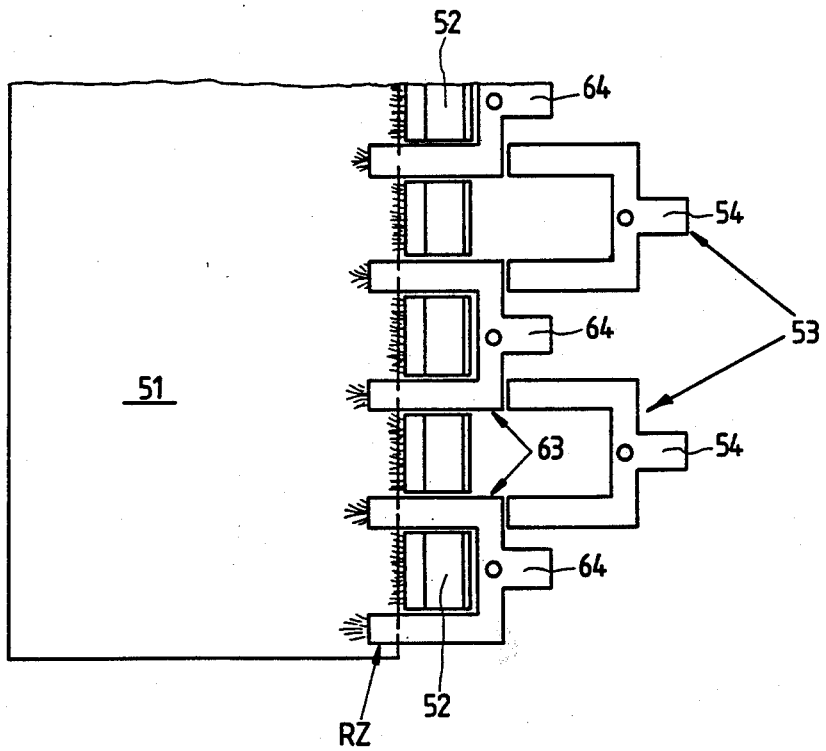
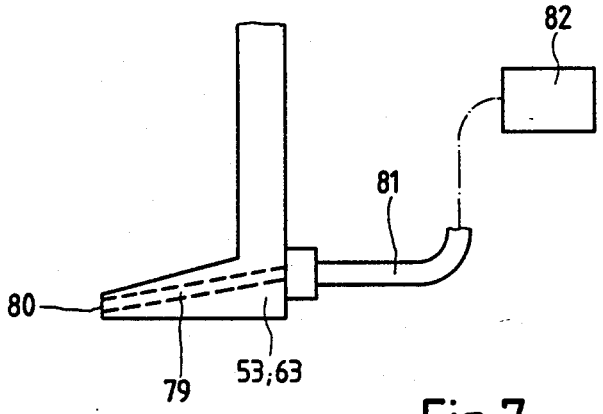
Fig.7

METHOD OF AND APPARATUS FOR GATHERING AND MANIPULATING STACKS OF PAPER SHEETS AND THE LIKE

CROSS-REFERENCE TO RELATED CASE

The apparatus of the present invention constitutes an improvement over and a further development of the apparatus which is disclosed in commonly owned copending patent application Ser. No. 044,959 filed Apr. 30, 1987 now U.S. Pat. No. 4,765,790 for "Apparatus for accumulating stacks of paper sheets and the like".

BACKGROUND OF THE INVENTION

The invention relates to improvements in methods of and apparatus for gathering panels or sheets (e.g., sheets made of paper, metallic foil, plastic foil or the like) into stacks of two or more overlapping sheets. More particularly, the invention relates to improvements in a method of and in an apparatus for gathering panels or sheets into a series of successive stacks at a first station and for transporting successively gathered stacks from the first station to a second station, e.g., to a wrapping or packing station.

It is often necessary to gather a single stream or several streams of discrete panels or sheets (hereinafter called sheets for short) into relatively small or relatively large accumulations in the form of piles or stacks each of which can comprise a small number of sheets (e.g., a few very large sheets) or a large number (e.g., a full ream) of sheets so as to facilitate further manipulation of the accumulations, e.g., to facilitate the assembly of such accumulations into larger piles or stacks, subdivision of piled-up sheets into smaller piles or stacks, simultaneous severing of sheets forming a pile or stack, storage of piles or stacks, or wrapping and boxing or crating of piles or stacks. As a rule, a single stream of discrete partially overlapping or non-overlapping sheets is formed at a cutting station wherein one or more knives repeatedly sever a single continuous strip or web or two or more overlapping strips or webs of paper, metallic foil, plastic foil or like material. The sheets of the stream must be converted into a series of piles or stacks (hereinafter called stacks for short) at the rate at which they are formed at the cutting station. Moreover, it is often desirable or absolutely necessary to ensure that each of a short or long series of stacks will contain the same number or a predetermined number of overlapping sheets.

OBJECTS AND SUMMARY OF THE INVENTION

An object of the invention is to provide a method of gathering discrete sheets or groups of overlapping sheets into a series of successive stacks of overlapping sheets or groups of sheets, and of thereupon manipulating the stacks in a novel and improved way in a small area, with a high degree of predictability and without changing the relationship of neighboring sheets relative to each other.

Another object of the invention is to provide a method which renders it possible to gather and process a large number of sheets and stacks per unit of time, and to carry out the processing or manipulating operation in such a way that it does not interfere with the gathering of sheets or groups of sheets into stacks.

A further object of the invention is to provide a method which renders it possible to gather a continuous stream of sheets or groups of sheets into a continuous series of stacks and to predictably segregate the outermost sheets of neighboring stacks from one another in a simple, space- and time-saving manner.

An additional object of the invention is to provide a method which can be practiced with a high degree of predictability and reproducibility regardless of the size of sheets or group of sheets, and which renders it possible to transport tall, medium tall or relatively low stacks of sheets at a high or very high speed without risking misalignment of neighboring sheets.

Still another object of the invention is to provide a novel and improved apparatus for the practice of the above outlined method and to construct and assemble the apparatus in such a way that it can gather sheets or groups of sheets into stacks and process the stacks in a small area and without risking defacing of and/or other damage to the sheets.

An additional object of the invention is to provide the apparatus with novel and improved means for advancing successive stacks of a series of stacks from a gathering station to a further station, e.g., to a packing or wrapping station.

A further object of the invention is to provide the apparatus with novel and improved means for effectively segregating neighboring stacks of the series of stacks from each other.

Another object of the invention is to provide the apparatus with novel and improved means for preventing changes in orientation of sheets or groups of sheets which form the stacks, especially during the initial stage or stages of movement of a fully grown or gathered stack from the gathering or building station to another station.

A further object of the invention is to provide novel and improved means for advancing stacks in the above outlined apparatus.

Another object of the invention is to provide the apparatus with novel and improved means for supporting growing and fully grown stacks.

An additional object of the invention is to provide novel and improved means for synchronizing the movements of various parts in the above outlined apparatus.

A further object of the invention is to provide a production line which embodies the above outlined apparatus.

An additional object of the invention is to provide the apparatus with novel and improved means for repeatedly aligning the stacked sheets or groups of sheets to ensure the formation of satisfactory stacks not later than upon completed transfer of successive stacks from the gathering station.

One feature of the present invention resides in the provision of a method of accumulating or gathering and manipulating stacks of sheets. The method comprises the steps of gathering sheets into a series of stacks at a first station, and advancing successive stacks of the series from the first station to a second station. The advancing step includes supporting successive stacks from below and holding successive stacks from above, at least during the initial stage of advancement of a stack from the first station. The gathering step preferably includes maintaining successive stacks of the series in an orientation such that each stack has an underside and an upper side. The supporting step of such method includes contacting at least the major part of the underside and the holding step includes contacting a relatively small portion of the upper side of the stack which is being advanced from the first station. The stack which is being advanced from the first toward the second station moves in a predetermined direction, and the holding step preferably includes engaging the leader of the upper side of the stack at the first station, namely that portion of the upper side of the stack which is nearest to the second station (if the path along which the stacks are advanced from the first to the second station is a straight path).

The gathering step preferably includes feeding sheets into the first station from above to form a first growing stack and a second growing stack on top of the first stack when the first stack is fully grown. Each fully grown stack has an upper side and the holding step preferably includes engaging the upper side of the fully grown stack by at least one first jaw to thus separate the fully grown stack from the growing stack above it. The gathering step of such method further includes converting the second growing stack into a second fully grown stack which is located on top of the fully grown first stack and has an upper side, and feeding sheets on top of the second fully grown stack to form a growing third stack. The holding step of such method further comprises engaging the upper side of the second fully grown stack by at least one second jaw to thereby separate the second fully grown stack from the growing third stack. The advancing step of such method includes transferring the first fully grown stack ahead of the second fully grown stack so that the first station is continuously occupied by at least one fully grown stack and a growing stack on top of the at least one fully grown stack. Such method can further comprise the step of lowering the second fully grown stack jointly with the at least one second jaw and growing third stack upon completed advancement of the first fully grown stack so that the second fully grown stack descends at least close to the level which was theretofore occupied by the first stack. Such method can further comprise the steps of lifting the at least one first jaw, at least by the height of a fully grown stack, upon at least partial completion of advancement of the first stack from the first station, and moving the at least one first jaw into engagement with the upper side of the third stack upon completed conversion of the third stack into a fully grown stack so that the at least one first jaw separates the fully grown third stack from a fourth stack which grows on top of the third stack. The advancing step of such method further comprises advancing the fully grown second stack from the first station and the additional steps of lowering the third and fourth stacks with the at least one first jaw, raising the at least one second jaw at least by the height of a fully grown stack upon at least partial completion of advancement of the second stack from the first station, and moving the at least one second jaw into engagement with the upper side of the fourth stack upon completed conversion of the fourth stack into a fully grown stack so that the at least one second jaw separates the fully grown fourth stack from a fifth stack which grows on top of the fourth stack. The at least one first jaw and the at least one second jaw descend with alternate fully grown stacks and are raised above the upper sides of the respective fully grown stacks upon at least partial completion of advancement of such stacks from the first station.

The supporting step preferably includes engaging successive stacks of the series by at least one belt conveyor, and the advancing step of such method further comprises moving the conveyor with the stack thereon during a first stage and driving the conveyor during the next-following stage of advancement of a stack from the first to the second station so that the conveyor then advances the stack thereon from the first station. The moving step of such method preferably includes mounting the conveyor on a reciprocable carriage and moving the carriage and the conveyor thereon in a predetermined direction to advance the stack on the conveyor from the first station. The driving step includes moving the conveyor relative to the carriage during the aforementioned next-following stage of advancement of the stack on the conveyor from the first station so that the conveyor moves the stack thereon relative to the carriage. The holding step of such method includes engaging the stack on the conveyor with a jaw and moving the jaw with the stacks, at least during a portion of the first stage of advancement of the stack from the first station, and such method preferably further comprises the step of thereupon lifting the jaw above and away from the stack on the conveyor. Such method can also comprise the steps of lowering the next-following stack of the series of stacks to the level of the stack on the conveyor upon completed advancement of the stack on the conveyor from the first station, and moving the conveyor and the carriage counter to the predetermined direction to thereby return the conveyor to a starting position in which the conveyor is ready to engage the lowered stack of the series. Such method can further comprise the step of supporting the next-following stack from below in the course of the lowering step. Such step of supporting the next-following stack of the series can include contacting at least a major part of the underside of the next-following stack. For example, this can be accomplished by placing beneath the next-following stack an air table and blowing air or another suitable gaseous fluid from the air table against the underside of the next-following stack. The step of placing the table preferably includes moving the table in the predetermined direction in synchronism with the carriage during the aforementioned initial stage of advancement of the stack on the conveyor from the first station.

The method can further comprise the steps of admitting a compressed gaseous fluid between successive stacks of the series to thus separate successive stacks from one another by cushions of gaseous fluid.

The method can further comprise the steps of mechanically separating successive stacks of the series of stacks from each other, lowering successive stacks of the series at the first station, and terminating the mechanical separating step between a preceding stack and the next-following stack of the series of stacks when the preceding stack reaches the first station.

The advancing step can further include pushing successive stacks of the series of stacks from the first station. The arrangement is preferably such that the pushing step includes applying pressure to the rear side of the stack which is about to leave the first station, namely to that side which faces away from the direction of advancement of the stack from the first toward the second station.

Another feature of the invention resides in the provision of an apparatus for accumulating and manipulating stacks of sheets. The apparatus comprises means for gathering sheets into a series of stacks at a first station, and means for advancing successive stacks of the series from the first station to a second station. The advancing means includes mobile means for supporting successive stacks of the series from below and means for holding successive stacks from above, at least during the initial stage of advancement of stacks from the first station. The supporting means preferably includes means for contacting at least the major part of the underside of the stack at the first station, and the holding means preferably includes means for contacting a relatively small portion of the upper side of the stack at the first station. The advancing means includes means for advancing successive stacks of the series in a predetermined direction, and the holding means preferably includes means for contacting the leader of the upper side of the stack at the first station, namely that part of the upper side of the stack at the first station which is nearest to the front end face of such stack. If the path of movement of stacks from the first to the second station is a straight path, the front surface of the stack at the first station faces toward the second station. The holding means can include at least one first jaw having an underside which serves to contact the upper side of the stack at the first station. The gathering means of such apparatus preferably includes means for feeding sheets to the first station from above so as to form a growing first stack and a growing second stack on top of the first stack when the first stack is fully grown. The advancing means of such apparatus preferably includes means for moving the first jaw between the fully grown first stack and the growing second stack at the first station so that the jaw separates the topmost sheet of the first stack from the lowermost sheet of the second stack. The moving means can include means for lifting the first jaw, at least by the height of a fully grown stack, upon completed advancement of the fully grown first stack from the first station.

The feeding means of such apparatus preferably comprises means for forming a growing third stack on top of the second stack upon completed conversion of the second stack into a fully grown stack, and the advancing means of such apparatus further comprises a second jaw and means for moving the second jaw between the fully grown second stack and the growing third stack so that the second jaw separates the topmost sheet of the second stack from the lowermost sheet of the third stack. Such apparatus preferably further comprises means for lowering the fully grown second stack at the first station with the second jaw upon completed advancement of the fully grown first stack from the first station. The moving means can include means for alternately raising and lowering each of the first and second jaws, and means for controlling such raising and lowering means so that one of the jaws descends with the topmost fully grown stack while the other jaw rises to engage the upper side of the next fully grown stack, and the position of the jaw on top of a fully grown stack with reference to such stack remains unchanged until after the stack leaves the first station.

The supporting means preferably comprises at least one belt conveyor, a carriage for the belt conveyor, and means for driving the belt conveyor relative to the carriage. Such apparatus preferably further comprises means for driving the carriage and the conveyor relative to the first and second stations. The holding means of such apparatus includes at least one mobile jaw, and such apparatus further comprises means for moving the jaw relative to the stations, and control means for the moving means and the driving means. The control means includes means for initiating disengagement of the jaw from the stack on the conveyor and thereupon a movement of the conveyor and of the stack on the conveyor relative to the carriage while the carriage is in motion. The driving means can include a plurality of pulleys including pulleys mounted on the carriage and at least one driven pulley, and means for breaking (preferably to fully stop) at least one of the pulleys.

The driving means can include means for moving the conveyor and a stack on the conveyor in a first direction toward the second station and in the second direction counter to the first direction upon completed transfer of a stack from the conveyor. Such apparatus further comprises means for lowering successive stacks of the series of stacks at the first station so that a fresh stack is located above the conveyor when the conveyor completes its movement in the second direction.

The apparatus can further comprise means for lowering successive stacks of the series of stacks at the first station, and such lowering means can include an air table having a plurality of ports and means for supplying to such ports a compressed gaseous fluid so as to form a fluid cushion between the table and the stack on the table. The supporting means of such apparatus comprises the aforementioned carriage and drive means for moving the carriage in synchronism with the table to and from the first station so that the carriage is located at the first station beneath a preceding stack of the series of stacks when the table is remote from the first station, and that the table is located at the first station beneath the next-following stack of the series of stacks when the carriage is remote from the first station.

The apparatus can further comprise means for admitting a compressed gaseous fluid between successive stacks of the series of stacks to thereby segregate neighboring stacks from each other.

The apparatus can further comprise means for mechanically separating the stack at the first station from the next-following stack of the series of stacks.

Still further, the advancing means of the improved apparatus can include a pusher, and the pusher is preferably actuatable to move the stack which occupies the first station toward the second station by bearing against that side of the stack at the first station which faces away from the second station.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing. cl BRIEF DESCRIPTION OF THE DRAWING FIG. 1 is a schematic elevational view of an apparatus which embodies one form of the invention, two fully grown stacks and a growing stack being located at the first station and the lower one of the fully grown stacks being ready for advancement toward the second station;

FIG. 6 is an enlarged plan view of a detail in the apparatus of FIGS. 1 to 5; and FIG. 7 is a schematic elevational view of means for admitting a gaseous fluid between neighboring stacks at the first station.

DESCRIPTION OF THE PREFERRED EMBODIMENTS

Figure 1:
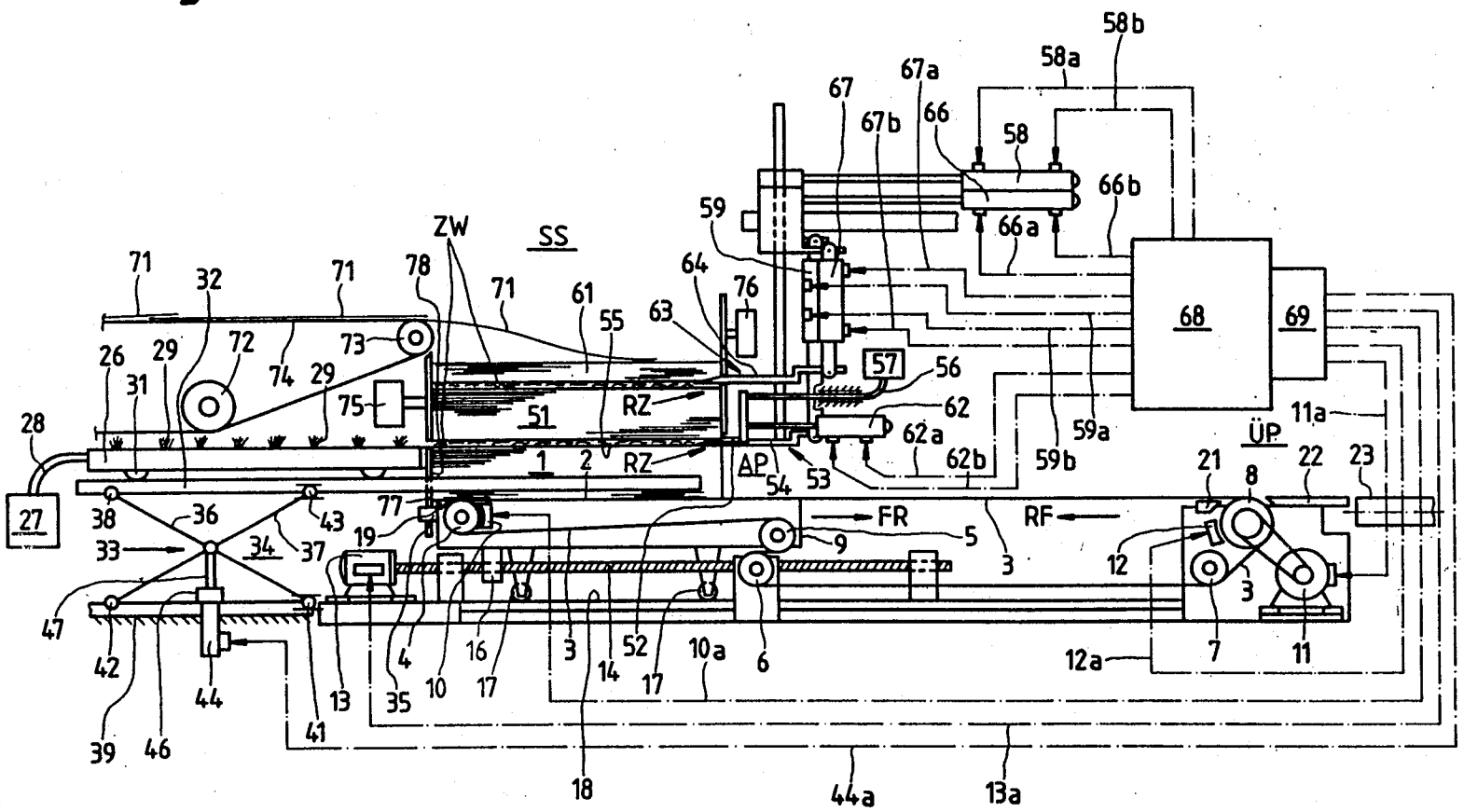

FIG. 1 shows all important details of the improved apparatus, and FIGS. 2–5 show stacks of superimposed paper sheets during different stages of advancement from a first (stacking or stack building) station SS to a second (transfer) station ÜP.

Referring first to FIG. 1, the means for accumulating or gathering a succession of stacks 1, 51, 61 . . . comprises an endless belt conveyor 74 which transports a stream of partially overlapping paper sheets 71 to the stacking station SS where the sheets pile up on top of each other to form a first growing stack which, when fully grown, constitutes the stack 1, thereupon a second growing stack which, when fully grown, constitutes the stack 51, and thereupon a third growing stack 61 on top of the fully grown stacks 1 and 51. The first or lowermost fully grown stack 1 occupies a position AP in which it is ready for removal from the station SS and for advancement toward and into the transfer station ÜP. The direction of movement of the stack 1 from the station SS to the station ÜP is indicated by the arrow FR.

The means for supporting at least the major part of the underside 2 of the stack 1 includes a set of parallel endless belt conveyors 3 (only one can be seen in FIG. 1) and a carriage 9 on which certain pulleys 4, 5 for the belt conveyors 3 are mounted. The planes of conveyors 3 are disposed one behind the other (as seen in FIG. 1) and the neighboring conveyors 3 may but need not be immediately or very closely adjacent each other. At any rate, the upper reaches of conveyors between their common pulley 4 and a further common pulley 8 contact at least the major part of the underside 2 of the stack 1 so as to ensure that such stack is immediately set in motion in response to advancement of belt conveyors 3 with and/or relative to their carriage 9.

The pulley 8 for the conveyors 3 is mounted in the frame of the improved apparatus, the same as two additional pulleys 6 and 7. The pulleys 4 and 5 are idler pulleys and the carriage 9 supports an electrically operated brake 10 which can be engaged to at least reduce the speed of but preferably to arrest the pulley 4 so that the upper reaches of the belt conveyors 3 are then compelled to share all movements of the carriage 9 and to remain at a standstill if the carriage is idle. The means for driving the belt conveyors 3 relative to the carriage 9 comprises an electric motor 11 which is installed in or on the frame of the apparatus and can transmit torque to the pulley 9 through the medium of an endless belt. The pulley 8 slips relative to the belt conveyors 3 when the brake 10 for the pulley 4 is applied. An electrically operated brake 12 can be applied to arrest the pulley 8.

The driving means which can move the carriage 9 in the direction of arrow FR or in the opposite direction (note the arrow RF) comprises a reversible electric motor 13 serving to rotate a elongated feed screw 14 which is journalled in the frame of the apparatus and mates with a nut 16 affixed to or forming an integral part of the body of the carriage 9. The carriage 9 is further provided with wheels 17 which are arranged to travel in directions indicated by arrows FR and RF by rolling along a suitable base or track 18, for example, a track having two elongated parallel rails extending between the stations SS and ÜP.

When the carriage 9 is held in the left-hand end position of FIG. 1, the left-hand marginal portion of the underside 2 of the stack 1 rests on a guide member 19. Additional guide members 21 and 22 are provided adjacent the upper reaches of the belt conveyors 3 at the station ÜP to guide successive increments of the underside 2 of the stack 1 while the stack advances through and beyond the station ÜP to come to rest on the upper reach of a further belt conveyor 23 serving to receive successive fully grown stacks from the supporting means including the conveyors 3 and to transport successive fully grown stacks to the next processing station, for example, into a packing or wrapping machine of any known design. Such machine can be designed to wrap successive reams of 500 paper sheets each into suitable wrapping paper before a predetermined number of wrapped reams of sheets 71 are confined in a box, carton or another suitable receptacle.

The carriage 9 for the pulleys 4 and 5 is connected with one end portion of a so-called air table 26 the upper side of which is formed with a plurality of ports 29 for streamlets of compressed air or another suitable gaseous fluid which is supplied by a source 27 by way of a flexible conduit 28. The exact construction of the air table 26 forms no part of the present invention. Such air tables are known in the art of manipulating and transporting paper sheets. The illustrated air table 26 is mounted on wheels 31 which can travel along elongated guide rails 32 extending in parallelism with th directions of reciprocatory movement of the carriage 9. The body of the table 26 has a plurality of passages in the form of channels, bores or the like which receive compressed air from the conduit 28 and admit such air to the ports 29 when the table is in actual use, namely when it is called upon to establish a cushion of air along its upper side, namely beneath a stack (such as the stack 51) which is to be lowered by the table 26 from the level shown in FIG. 1 to the level AP of the first or lowermost stack 1. The arrangement is preferably such that each port 29 in the upper side of the air table 26 receives a portion of a spherical valving element (not specifically shown) which is biased into the respective port 29 by the mass of compressed air in the interior of the table. When the underside of a fully grown stack (such as the stack 51) comes to rest on the table 26, the stack depresses the exposed upwardly extending portions of the spherical valving elements so that the valving elements permit streamlets of compressed air to issue from the table and to form the aforementioned cushion. Coil springs or other suitable means can be provided to yieldably bias the spherical valving elements to their operative positions, and the bias of such coil springs is assisted by compressed air in the interior of the table 26 when the channels and/or bores of the table are connected to the sources 27 of compressed gaseous fluid. The purpose of the cushion of compressed gaseous fluid above the table 26 is to reduce friction between the table and a stack of paper sheets 71 thereon.

The front (right-hand) end portion of the table 26 is coupled to the carriage 9 in such a way that the table is compelled to share the forward and return movements of the carriage in directions indicated by the arrows FR and RF. When the carriage 9 is in motion (namely when the feed screw 14 is rotated in a clockwise or in a counterclockwise direction), the air table 26 travels along the guide rails 32.

The rear end portion of the carriage 9 carries guides 35 for vertical rods which are secured to the front end portion of the air table 26 so as to enable the table to move up and down with reference to the carriage 9 while remaining coupled to the carriage for movement in directions which are indicated by arrows FR and RF. An elevator means 33 for moving the air table 26 up and down relative to the guides 35 on the carriage 9 comprises tongs 34 with two pairs of crossing legs 36 and 37. The median portions of the legs 36, 37 are pivotably mounted at the upper end of a feed screw 47 mating with a nut 46 which can be rotated by a reversible electric motor 44 so that the angles between the legs 36, 37 can be increased or reduced, depending upon the direction of vertical movement of the guide rails 32 for the air table 26. The upper end portions of the legs 36 are pivotably connected to the guide rails 32 by suitable joints or hinges 38, and the lower end portions of the legs 36 are pivotably connected to the guide rails 32 by suitable joints or hinges 38, and the lower end portions of the legs 36 are provided with bearings 41 which are slidable along the floor 39 of the plant in which the improved apparatus is put to use. In the embodiment which is shown in FIG. 1 the guide rails 32 can move up and down but do not share the reciprocatory movements of the carriage 9 and table 26.

The lower end portions of the legs 37 are pivotably connected to the floor 39 by joints or hinges 42, and the upper end portions of the legs 37 are provided with bearings 43 which are slidable along the respective guide rails 32. Such arrangement enables the tongs 34 of the elevator means 33 to raise and lower the guide rails 32 jointly with the air table 26 whereby the air table moves up and down relative to the guide means 35 on the carriage 9. The extent to which the air table 26 is movable up and down need not exceed, or need not appreciably exceed, the height of a fully grown stack 1.

The underside of the second fully grown stack 51 at the station SS is separated from the upper side 55 of the first fully grown stack 1 by a mechanical separating device including fingers or sections 52 (see FIG. 6) each of which is or can be connected with a source of compressed gaseous fluid so as to discharge streamlets or jets of compressed gaseous fluid (normally air) between the stacks 1 and 51. This is shown in FIG. 6.

The apparatus of FIGS. 1–7 further comprises a first holding means in the form of a composite jaw 53 having a plurality of bifurcated portions 54 (hereinafter called forks) which can penetrate between the neighboring stacks so as to engage the front marginal portion or leader RZ of the upper side 55 of the stack 1 at the stacking station SS. The jaw 53 can be said to constitute a means for holding the stack 1 at the station SS as well as during the initial stage of advancement of the stack 1 from the station SS toward the station ÜP. The area of contact between the underside 2 of the stack 1 at the station SS and the adjacent portions of the upper reaches of belt conveyors 3 is much larger than the area of contact between the undersides of the forks 54 forming part of the jaw 53 and the (front marginal portion or leader RZ of) the upper side 55 of the stack 1.

The prongs of the forks 54 are receivable between neighboring sections of the mechanical supporting device 52 for the underside of the stack 51 at the station SS. The undersides of the prongs of forks 54 not only contact and bear against the adjacent portion or leader RZ of the upper side 55 of the stack 1 to thus prevent any movement of the sheets 71 forming the stack 1 relative to each other but such prongs also serve as a means for separating the stacks 1 and 51 from each other, at least in the region of the marginal zone or portion RZ of the upper side 55 of the stack 1. The sections or fingers of the separating device 52 are hollow and are connected with a source 57 of compressed air by a flexible conduit 56 which is shown in FIG. 1. The source 57 can admit compressed air which is discharged by the sections of the mechanical supporting device 52 to establish a cushion of compressed air in the space ZW between the stacks 1 and 51 at the station SS. The purpose of the cushion of compressed air in the space ZW between the stacks 1 and 51 is to reduce friction between the upper side 55 of the stack 1 and the underside of the stack 51 so as to ensure a more predictable transport or advancement of the stack 1 from the station SS in response to advancement of the upper reaches of belt conveyors 3 toward the station ÜP or in response to movement of the carriage 9 in the direction which is indicated by arrow FR. FIG. 7 shows the presently preferred design of the forks of the jaw 53. The channels 79 in the prongs of the forks receive compressed air or another suitable gaseous fluid from a source 82 by way of flexible conduits 81. The outlet orifice at the front end of the channel 79 in the illustrated fork of the jaw 53 is shown at 80. As can be seen in FIG. 6, the orifices in the sections of the mechanical supporting device 52 and orifices of prongs of the forks 54 forming part of the jaw 53 can discharge a practically uninterrupted row of small streams of compressed air to establish and maintain the aforementioned air cushion in the space ZW between the upper side 55 of the stack 1 and the underside of the stack 51 at the station SS. All forks 54 of the jaw 53 are movable jointly into and out of the space ZW above the upper side 55 of the stack 1 by a common pneumatic motor 58 having elongated horizontal piston rods which can transmit motion to the forks 54 of the jaw 53. A further pneumatic motor 59 is provided to move the motor 58, its piston rods and the jaw 53 up and down so that the forks 54 can be lowered toward the carriage 9 or lifted above and away from the carriage in order to penetrate into the space ZW between two selected stacks of paper sheets at the station SS. The sections of the mechanical supporting device 52 are movable back and forth in a horizontal plane by a third pneumatic motor 62 which is adjacent the front side of the stack 51 at the station SS.

The upper side of the fully grown stack 51 at the station SS is disposed at a level beneath a second jaw 63 constituting a means for holding the front marginal portion or leader RZ of the upper side of the stack 51 during advancement of such stack from the station SS toward the station ÜP. Another purpose of the jaw 63 is to separate the upper side of the stack 51 from the underside of the growing stack 61 which is in the process of receiving additional sheets 71 from the upper reach of the belt conveyor 74. As shown in FIG. 6, the jaw 63 also comprises bifurcated portions or forks 64 each of which can receive compressed air from the source 82 (FIG. 7) by way of a flexible conduit 81. The orifices 80 and channels 79 in the forks 64 of the jaw 63 can be designed in the same way as shown for the forks 54 of the jaw 53 in FIG. 7.

The jaw 63 is movable back and forth (horizontally) independently of the jaw 53 by a further pneumatic motor 66 which is located beneath the motor 58. A motor 67 is provided to pneumatically move the jaw 63 up and down so that the prongs of the forks 64 can be moved to the level of one of the spaces ZW between a pair of neighboring stacks at the station SS. The prongs of the forks 64 can discharge streamlets of air which form a cushion of compressed air between the selected stacks, such as the stacks 51, 61 at the station SS of FIG. 1.

The pneumatic motors 58, 59, 62, 66 and 67 respectively receive and/or discharge compressed air by way of suitable flexible or fixed conduits 58*a*, 58*b*; 59*a*, 59*b*; 62*a*, 62*b*; 66*a*, 66*b* and 67*a*, 67*b*. For the sake of simplicity, such conduits are indicated in FIG. 1 merely by phantom lines. The flow of compressed gaseous fluid through the just enumerated conduits is regulated by a system of valves 68 which, in turn, are controlled by control means 69 of any known design. The control means 69 can include a suitable circuit which further controls the operation of the electric motor 11 by way of conductor means 11*a*, the operation of the electric brake 12 by way of conductor means 120*a*, the operation of the electric motor 13 by way of conductor means 13*a*, and the operation of the electric motor 44 by way of conductor means 44*a*. The control means 69 is further operatively connected (in a manner well known from the art and not specifically shown in the drawing) with the timing pulse generator or with other suitable timing means of the production line which includes the apparatus of FIG. 1 so as to ensure that the operation of the conveyor 74 and of the means for supplying the stream of sheets 71 to the upper reach of the conveyor 74 is properly synchronized with the operation of various mobile components of the improved apparatus in a manner to be described with reference to FIGS. 2–5.

The belt conveyor 74 is trained over pulleys including those shown in FIG. 1 at 72, 73, and its upper reach can receive the stream of sheets 71 from a suitable cutter, for example a cutter which divides one or more continuous webs or strips of paper into individual partly overlapping sheets 71. Cutter means which can subdivide webs or strips of paper or the like into individual sheets 71 can be of the type disclosed in commonly owned U.S. Pat. No. 4,484,501 granted November 27, 1984 to Ramcke.

FIG. 1 further shows suitable aligning devices 75, 76 which can constitute or include means for vibrating rear and front end walls at the station SS in order to facilitate the gathering of successive sheets 71 into stacks 1, 51, 61 in each of which the neighboring sheets 71 accurately overlap each other. In other words, each of the stacks at the station SS is preferably bounded by four vertical surfaces which are smooth or substantially smooth.

The means for advancing stacks from the station SS to the station ÜP further comprises a pusher 77 which is adjacent the rear end face or surface 78 of the stack 1 at the station SS and is designed to share at least a portion of forward movement of the stack 1 when the latter is caused to leave the station SS and to advance toward the station ÜP.

Figure 4:
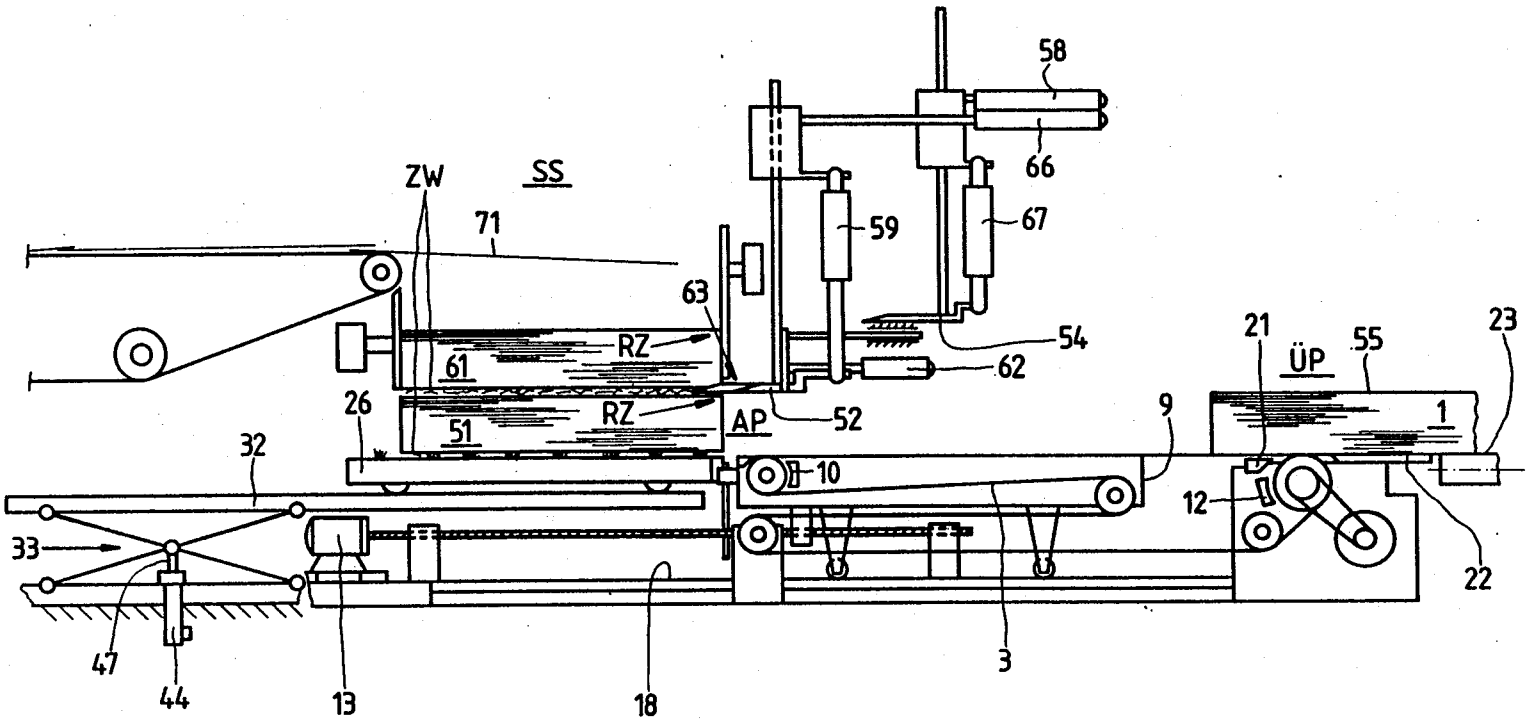
FIG. 4 shows the structure of FIG. 3, with a fully grown stack at the second station and two fully grown stacks at the first station.

FIG. 6 shows the mechanical supporting device 52, the forks 54 of the first holding means or jaw 53 and the forks 64 of the second holding means or jaw 63 in positions such parts assume during that stage of operation of the improved apparatus which is illustrated in FIG. 4.

Each of the conduits which are used in the improved apparatus (such as the conduit 81 of FIG. 7) can constitute a flexible hose.

The operation of the improved apparatus is as follows:

FIG. 1 shows the first or lowermost stack 1 of the series of fully grown stacks which are formed or gathered at the station SS in the position (AP) of readiness for transport or advancement toward the station ÜP. The underside 2 of the stack 1 is in large-area contact with the upper reaches of the belt conveyors 3. The control means 69 has transmitted a signal via conductor means 10*a* to apply the electric brake 10 so that the pulley 4 cannot rotate relative to the carriage 9. Consequently, when the motor 13 receives a signal via conductor means 13*a* to rotate the feed screw 14 so as to advance the carriage 9 in the direction of arrow FR, the upper reaches of the belt conveyors 3 share the ensuing rightward movement of the carriage 9 and advance the stack 1 from the stacking station SS. The rightward movement of the stack 1 is terminated when its underside 2 comes to rest on the conveyor 23 (FIG. 5) downstream of the transfer station ÜP so that the stack 1 can be transported into a processing station, such as a packing or wrapping station the details of which form no part of the present invention. It will be noted that the flexible conduits and electric conductor means are omitted in FIGS. 2–5 for the sake of clarity.

When the stack 1 is about the leave the station SS, the mechanical separating device 52 and the prongs of forks 54 of the jaw 53 extend into the space ZW between the stacks 1 and 51 so as to mechanically and pneumatically separate the stacks 1 and 51 from each other and to thus ensure that the lowermost sheet or sheets of the stack 51 will not be compelled to share the rightward movement of the topmost sheet of the stack 1 while the stack 1 advances with the carriage 9 and with the adjacent portions of upper reaches of the belt conveyors 3 toward the transfer station ÜP. The mechanical separating device 52 and the forks 54 of the jaw 53 then overlap the leader or front marginal zone RZ of the upper side 55 of the stack 1. The prongs of the forks 54 discharge streamlets of compressed air, the same as the sections or fingers of the mechanical separating device 52, so as to fill the space ZW between the fully grown stacks 1 and 51 with a cushion of compressed air which ensures that the lowermost sheet or sheets of the stack 51 are not likely to advance with the sheets of the stack 1 when the carriage 9 is set in motion to advance in the direction which is indicated by the arrow FR. The cushion of compressed air in the space ZW between the stacks 1 and 51 acts as a layer of lubricant which reduces friction between the respective stacks and reduces the likelihood of deformation of, or other damage to, the lowermost sheet or sheets of the stack 51 and/or to the uppermost sheet or sheets of the stack 1 when the carriage 9 is set in motion to leave the left-hand end position of FIG. 1.

FIG. 1 further shows that the prongs of the forks 64 forming part of the jaw 63 are located in the space ZW between the fully grown stack 51 and the growing stack 61 so that the cushion of air which is formed by jets of compressed air issuing from the orifices 80 of the prongs of forks 64 ensures the establishment of a clear-cut line or space of demarcation between the stacks 51 and 61. The jaw 63 overlies only the front marginal portion or leader RZ of the upper side of the fully grown stack 51 at the station SS.

As mentioned above, when the carriage 9 is set in motion by starting the motor 13 by way of conductor means 13*a*, the electric brake 10 is applied in response to a signal from the control means 69 by way of conductor means 10*a* so that the upper reaches of the belt conveyors 3 are compelled to share the movement of the carriage 9 toward the station ÜP. At the same time, the pneumatic motor 58 for the jaw 53 receives compressed air by way of the conduit 58*a* so that the jaw 53 moves in the direction of arrow FR in synchronism with the carriage 9 and the position of the jaw 53 relative to the stack 1 on the belt conveyors 3 remains unchanged. In other words, the jaw 53 rests on the front marginal portion or leader RZ of the upper side 55 of the stack 1 while the stack 1 advances toward the station ÜP. This enables the jaw 53 to perform its holding function, namely to prevent any shifting of sheets 71 forming part of the stack 1 relative to each other and relative to the upper reaches of the belt conveyors 3.

The brake 12 is disengaged at such time in response to a signal which is transmitted from the control means 69 by way of the conductor means 12*a*. At the same time, the electric motor 11 receives from the control means 69 a signal by way of conductor means 11*a* so that it rotates the pulley 8 in a clockwise direction whereby this pulley maintains the upper reaches of the belt conveyors 3 under requisite tension.

Alternatively, the electric motor 11 can be energized at all times and the control means 69 merely regulates the operation of the brake 12 for the pulley 8 so that the pulley 8 can tension the upper reaches of the belt conveyors 3 when necessary, i.e., during certain stages of transfer of successive stacks 1, 51, 61 . . . from the station SS toward the station ÜP. The RPM of the motor 11 is preferably selected in such a way that the peripheral speed of the pulley 8 slightly exceeds the speed of movement of the carriage 9 in the direction of arrow FR under the action of the electric motor 13 so that the upper reaches of the belt conveyors 3 are always taut.

The jaw 53 ensures that the stack 1 can be predictably withdrawn from the space beneath the stack 51 and that the stack 1 can be accelerated at the same rate as the carriage 9 when the motor 13 is started without causing any shifting of sheets 71 which form the stack 1 relative to each other and relative to the upper reaches of the belt conveyors 3. The separation of stacks 1 and 51 at the station SS is promoted by the cushion of compressed air which is formed in the lower space ZW by jets of air issuing from the orifices of the mechanical separating device 52 and from the orifices at the left-hand ends of the prongs forming part of the forks 54.

The pusher 77 assists the carriage 9 and the belt conveyors 3 in advancing the stack 1 from the station SS toward the transfer station ÜP. This pusher bears against the rear side or surface 78 of the stack 1.

Figure 2:
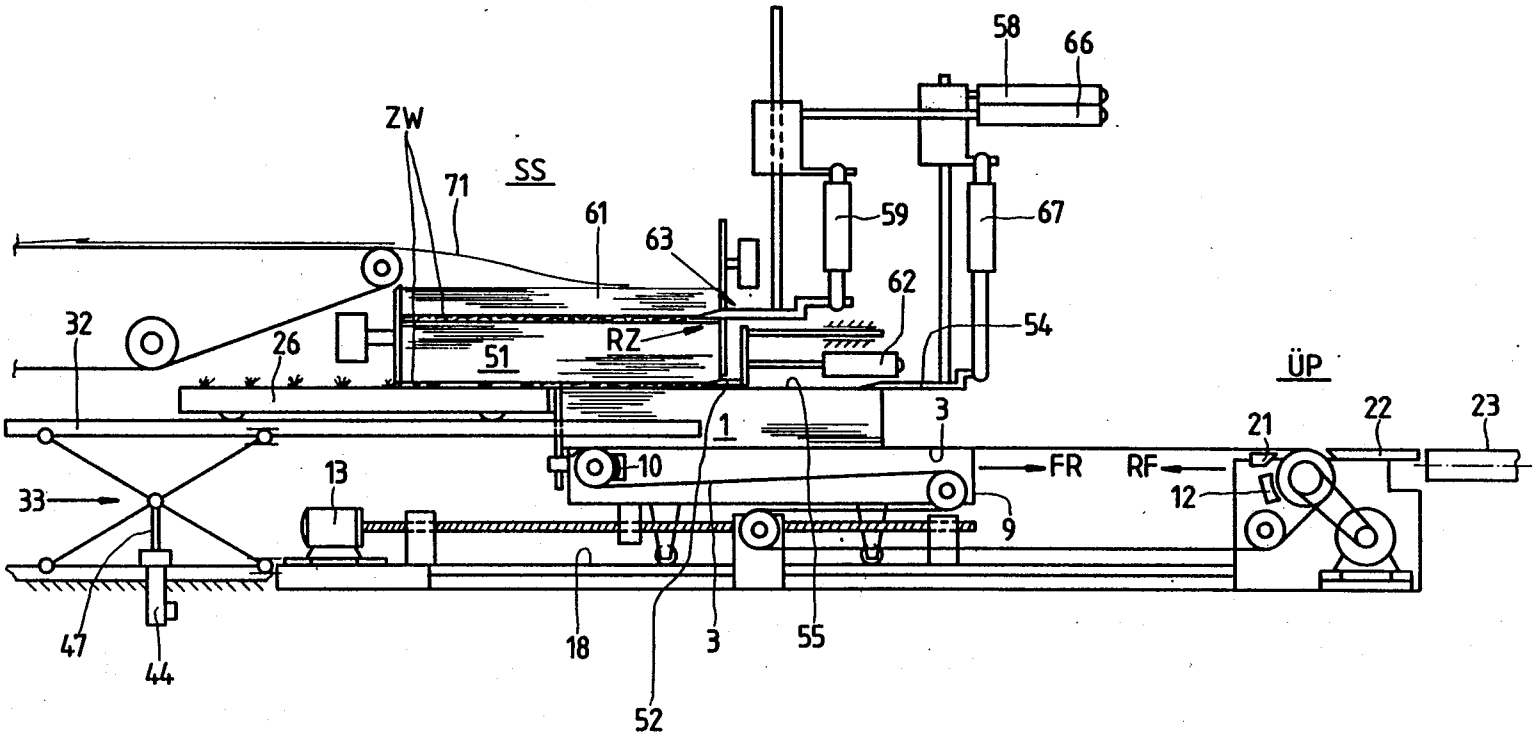
FIG. 2 shows certain parts of the apparatus of FIG. 1, with the lower fully grown stack on its way from the first station.

As shown in FIG. 2, the air table 26 shares the rightward movement of the carriage 9 and advances along its guide rails 32 into the stacking station SS so that it begins to indirectly support a progressively larger portion on the underside of the fully grown stack 51 whereby the latter remains at its previous level between the aligning devices 75 and 76. The ports 29 in the upper side of the air table 26 discharge streamlets of compressed air because the lowermost sheet on the stack 51 depresses a progressively increasing number of spherical valving elements in the body of the table 26. This results in the establishment of an air cushion which is formed between the increasingly larger area of the underside of the stack 51 and the table 26. Such cushion reduces friction between the stack 51 and the table 26 to thereby reduce the likelihood of deformation of and/or other damage to the sheets at the underside of the stack 51.

Figure 3:
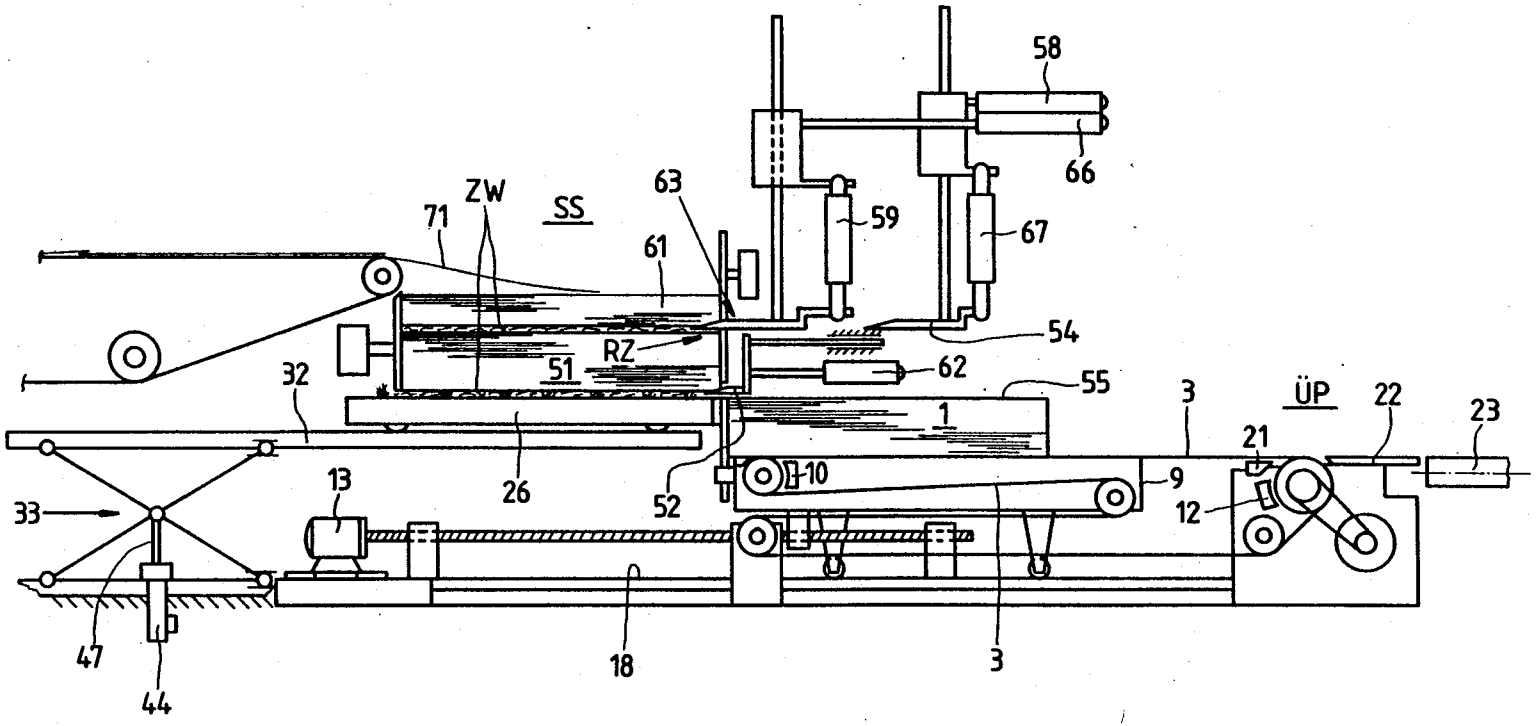
FIG. 3 shows the structure of FIG. 2 with the lower fully grown stack during a further stage of movement from the first toward the second station.

FIG. 3 shows that the pneumatic motor 59 has lifted the forks 54 of the jaw 53 above and away from the stack 1 on the belt conveyors 3 after the carriage 9 has completed its movement away from the position of FIG. 1. In other words, the forks 54 of the jaw 53 are lifted above and away from the upper side 55 of the stack 1. Consequently, the holding or engaging function of the forks 54 is terminated when the carriage 1 has been accelerated to a certain speed so that it is no longer necessary to push the topmost sheet or sheets of the stack 1 toward the upper reaches of the belt conveyors 3.

Figure 5:
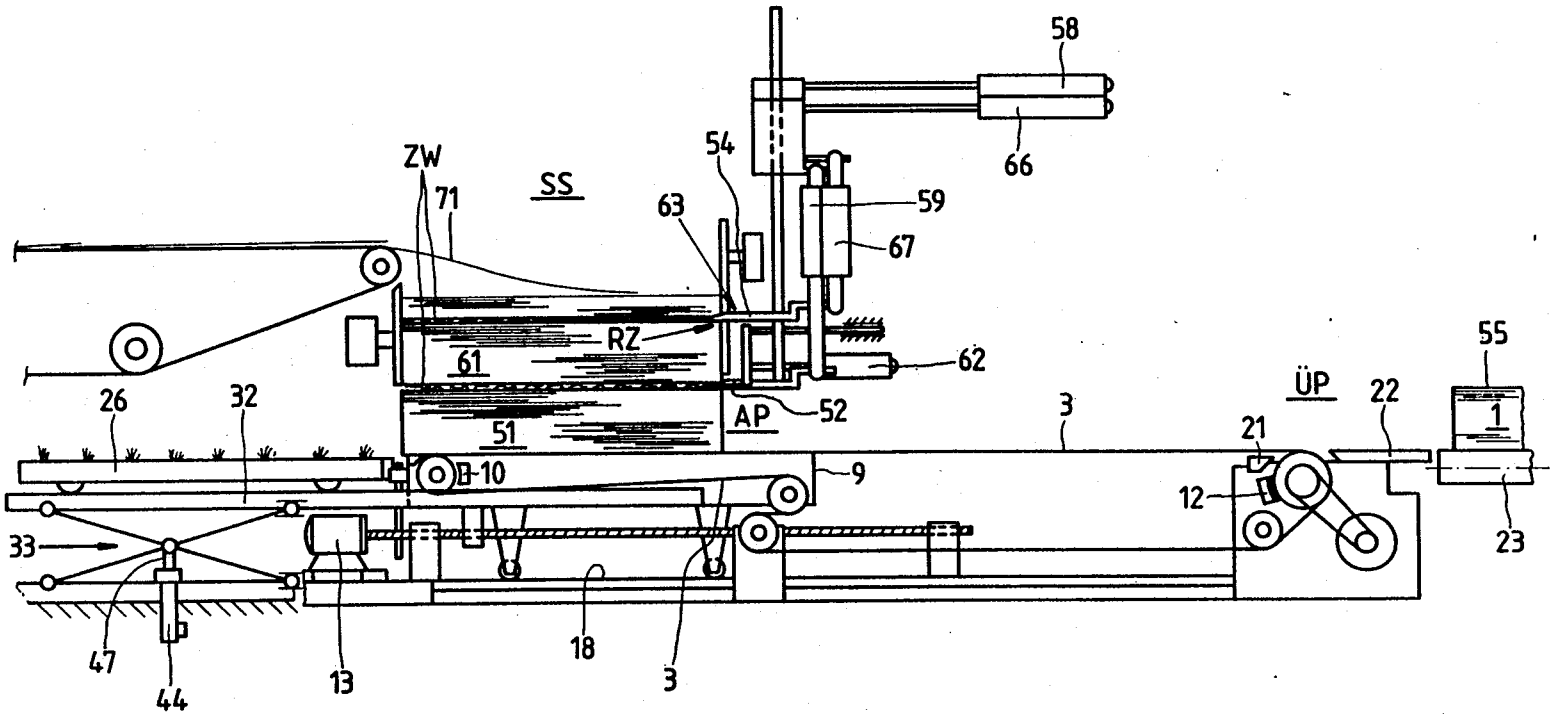
FIG. 5 illustrates the structure of FIG. 3, with the carriage and conveyor back at the first station and a partly grown stack on top of two fully grown stacks at the first station.

When the motor 59 has lifted the jaw 53 through a distance which equals or approximates the height of a fully grown stack, the pneumatic motor 58 is actuated by way of one of the valves 68 in response to a signal from the control means 69 so as to move the forks 54 back toward the station SS and the forks 54 penetrate into the space between the stack 61 and next-following (growing) stack (see FIG. 5). Such return movement of the jaw 53 into the station SS takes place when the growing stack 61 has been converted into a fully grown stack and it is necessary to segregate the fully grown stack 61 from the next-following (growing) stack. The mechanical separating or segregating action of the prongs of forks 54 is assisted by the cushion of compressed air which is formed as a result of discharge of streamlets of compressed air from the orifices of the prongs of forks 54.

When the jaw 53 is lifted above and away from the stack 1, the control means 69 transmits a signal via conductor means 10*a* to disengage the brake 10 so that the motor 11 is then free to drive the belt conveyors 3 relative to the carriage 9 in the direction of arrow FR. The motor 13 continues to rotate the feed screw 14 in a direction to move the carriage 9 toward the transfer station ÜP. The speed of the belt conveyors 3 relative to the moving carriage 9 can be regulated in such a way that it is substantially constant in space (for example relative to the base or track 18 for the wheels 17 of the carriage 9). At any rate, the motor 11 can drive the belt conveyors 3 in such a way that their speed is independent of the speed of movement of the carriage 9 under the action of the motor 13, feed screw 14 and nut 16.

When the carriage 9 reaches its right-hand end position (see FIGS. 3 and 4), the belt conveyors 3 continue to advance the stack 1 toward the transfer station ÜP, preferably in such a way that the speed of movement of the stack 1 toward the station ÜP remains at least substantially unchanged. The underside 2 of the stack 1 slides over the guide members 21 and 22 while the stack 1 continues to advance toward and ultimately reaches and is entrained by the conveyor 23. As mentioned above, the conveyor 23 can advance successive stacks to a processing station, such as to a station which accommodates a wrapping or packing machine of any known design.

It is also possible to operate the means for advancing successive stacks from the station SS onto the conveyor 23 in such a way that the conveyors 3 remain idle (relative to the carriage 9) while the carriage advances from the position of FIG. 1 to the position of FIG. 3. When the carriage 9 comes to a halt, the belt conveyors 3 are set in motion with reference to the carriage to complete the advancement of stack 1 toward and beyond the transfer station ÜP. The aforedescribed mode of operation is preferred because it takes less time to transfer a stack from the station SS onto the conveyor 23. This will be readily appreciated since the conveyors 3 can start their movement relative to the carriage 9 before the carriage reaches the right-hand end position of FIGS. 3 and 4, i.e., it is not necessary to bring the stack 1 to a halt in a position between the position of FIG. 1 and the position on the conveyor 23. In other words, the first-described mode of operation renders it possible to avoid a deceleration of the stack 1 to zero speed and a renewed acceleration with the belt conveyors 3 while such conveyors move relative to the carriage 9 to complete the transfer of the stack 1 from the station SS onto the conveyor 23.

It will be readily appreciated that acceleration and deceleration of relatively tall stacks of paper sheets or like sheets cannot be carried out at any desired rate because this could entail a shifting of neighboring sheets relative to each other. Therefore, it is highly desirable to avoid repeated acceleration and deceleration of stacks of superimposed sheets, especially if the stacks are to be gathered and transported and further processed while their sheets remain in accurate alignment with each other. In other words, the aforediscussed mode of starting the conveyors 3 relative to the carriage 9 before the carriage reaches the position of FIG. 3 renders it possible to eliminate an undesirable bottleneck in a processing machine wherein successive stacks of paper sheets or the like must be transported from the gathering or stacking station to the next station for processing in a packing, wrapping or like machine.

The holding means in the form of jaw 53 renders it possible to rapidly accelerate the stack 1 during movement from the station SS because such stack is then actually clamped between the undersides of the forks 54 and the upper sides of the upper reaches of belt conveyors 3 at a level above the carriage 9. Once the carriage 9 is accelerated, the jaw 53 is lifted in the aforedescribed manner by the motor 59 so as to be lifted above and away from the upper side 55 of the stack 1 at a time when the stack is already accelerated so that its sheets are unlikely to slide relative to each other. As mentioned above, if the belt conveyors 3 are set in motion relative to the carriage 9 before the carriage comes to a halt, proper regulation of the speed of the motor 11 can readily ensure that there is no need for further acceleration or deceleration of the stack 1 before the stack reaches its position above the conveyor 23 so that it can be entrained by this conveyor for advancement into the processing station.

When the carriage 9 reaches its right-hand end position which is shown in FIGS. 3 and 4, the stack 51 rests entirely on the air cushion above the table 26 and is ready to be lowered by the elevator 33 between the levels which are shown in FIGS. 3 and 4. This is achieved by transmitting an appropriate signal to the electric motor 44 via conductor means **44*a* so that the acute angles between the arms 36, 37 of the tongs 34 are decreased and the rails 32 are caused to descend and lower the table 26 and the stacks 51, 61. The downward movement of the rails 32 is terminated when the lowermost fully grown stack 51 reaches the level AP which is the former level of the stack 1. Downward movement of the table 26 from the position of FIG. 3 to the position of FIG. 4 is preceded by activation of the pneumatic motor 62 which retracts the mechanical separating device 52 so that the sections or fingers of the device 52 cannot interfere with downward movement of the stacks 51 and 61. The motor 62 is thereupon actuated again so as to introduce the sections of the separating device 52 into the space ZW between the stacks 51 and 6**.

The pneumatic motor 67 lowers the jaw 63 in synchronism with downward movement of the table 26 so that the prongs of the forks 64 continue to contact the front marginal portion or leader RZ of the upper side of the stack 51 while the stack 51 descends from the level of FIG. 1 to the level AP of FIG. 4. In other words, the holding and separating action of the jaw 63 remains unchanged while the pile of stacks above the table 26 descends with the guide rails 32 from the level of FIG. 3 to the level of FIG. 4.

When the stack 1 has advanced beyond the upper reaches of the belt conveyors 3, the control means 69 transmits to the motor 13 a signal via conductor means 13a so that the motor 13 reverses the direction of rotation of the feed screw 14 and the nut 16 moves the carriage 9 in the direction of arrow RF. At such time, the brake 12 is actuated in response to a signal from control means 69 via conductor means **12*a* so that it engages and holds the pulley 8 against rotation. The brake 10 is disengaged so that the upper reaches of the belt conveyors 3 are simply superimposed from below upon successive increments of the underside of the stack 51 without performing any longitudinal movements relative to the stack 51. This ensures that the belt conveyors 3 cannot shift the lowermost sheet or sheets of the stack 51 during return movement of the carriage 9 to the position of FIG. 1, i.e., to the position of FIG. 5. That portion of the underside of the stack 51 at the level AP which is not as yet supported by the belt conveyors 3 during movement of the carriage 9 back to the position of FIG. 5 continues to be supported by the cushion of air above the table 26 which travels in a direction to the left, i.e., back to the position which is shown in FIGS. 1 and 5. In other words, one portion of the underside of the stack 51 is invariably supported by the table 26 while the carriage 9 moves from the position of FIG. 4 to the position of FIG. 5, and the remaining portion of the underside of the stack 51 is supported by the upper reaches of the belt conveyors 3. Return movement of the air table 26 to the position which is shown in FIGS. 1 and 5 takes place while the rails 32 are held in their lower end positions by the tongs 34 of the elevator 33**.

When the stack 61 above the stack 51 is fully grown (see FIG. 5), the pneumatic motor 58 causes the jaw 53 to penetrate between the stack 61 and the growing stack above the stack 61 so that the growing stack is fully separated from the upper side of the fully grown stack 61.

The electric motor 44 then receives a signal by way of conductor means **44*a* so as to operate the elevator means 33 in a sense to return the guide rails 32 and the table 26 to the raised positions of FIG. 1. When such raising of the table 26 is completed, the apparatus is ready to advance the stack 51 (which is then located at the level AP) from the stacking station SS to the transfer station ÜP and thence onto the conveyor 23 in the same way as described above in connection with the stack 1**.

It will be seen that the jaws 53 and 63 alternately move upwardly and downwardly so as to hold the respective fully grown stacks from above during the initial stage of advancement of such stacks from the station SS as well as to penetrate between a fully grown stack and the growing stack above the fully grown stack when they return to the station SS. It has been found that such manipulation of the jaws 53, 63 renders it possible to properly segregate neighboring stacks from each other as well as to rapidly accelerate the fully grown stacks during advancement from the station SS without risking any shifting of the sheets in such stacks relative to each other. Once a jaw has assumed its operative position in one of the spaces ZW so that it overlies the front marginal portion or leader RZ of the fully grown stack below it, its position relative to such stack remains unchanged until after the stack has been advanced, at least in part, beyond the station SS and has been accelerated to requisite speed so that it is not likely to permit any shifting of its sheets relative to each other during further acceleration (if any is necessary) in a direction toward the station ÜP.

The path of reciprocatory movement of the carriage 9 and air table 26 may but need not be exactly horizontal.

The improved method and apparatus exhibit a number of important advantages. For example, the stack which is about to be advanced from the station SS is properly engaged from above and from below so that its sheets cannot be shifted relative to each other. This holds true regardless of the selected height of fully grown stacks, i.e., independently of the number of sheets 71 in each stack.

Another important advantage of the improved method and apparatus is that the gathering of sheets 71 into a succession of stacks can continue while successive lowermost fully grown stacks 1, 51, 61 . . . are being transferred from the station SS toward and beyond the station ÜP.

A further important advantage of the improved method and apparatus is that neighboring stacks are invariably properly segregated from each other, not only mechanically (by the device 52) but preferably also pneumatically so as to greatly reduce or practically eliminate the likelihood of any shifting of sheets at the upper side of a fully grown stack and at the underside of the stack above it.

The feature that the apparatus can properly operate with only two jaws 53 and 63 contributes to compactness and simplicity of the improved apparatus. Thus, all that is necessary is to properly program the operation of motors 58, 66 and 59, 67 which move the jaws 53, 63 forwardly and backwards as well as up and down so that these jaws are alternately movable to different levels above and below each other in order to ensure proper segregation of neighboring stacks from one another as well as proper retention of the sheets 71 of fully grown stacks against shifting during evacuation from the station SS. The transition from the segregating to holding function of each of the jaws 53, 63 is not noticed, as far as the sheets of the stacks below such jaws are concerned.

Another important advantage of the improved method and apparatus is that eventual variations of the speed of carriage 9 need not or do not affect the speed of advancement of stacks 1, 51, etc. from the station SS toward and beyond the station ÜP. This is due to the fact that the belt conveyors 3 are movable with as well as relative to the carriage 9 for reasons which are fully described above. Such mode of operating the driving means for the carriage 9 and belt conveyors 3 renders it possible to rapidly accelerate successive fully grown stacks to a relatively high speed such as cannot be readily reached in conventional apparatus without risking shifting of sheets which form the fully grown stacks.

The exact details of the system of valves 68 of the control means 69 form no part of the present invention. The manner of programming a number of valves, motors and brakes to operate in a predetermined sequence is well known in the art and need not be described here.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of accumulating and manipulating stacks of sheets, comprising the steps of gathering sheets into a series of stacks at a first station, including feeding sheets into the first station from above to form a first growing stack and a second growing stack on top of the first stack when the latter is fully grown; and advancing successive stacks of the series from the first to a second station, including supporting successive stacks from below, holding successive stacks from above, at least during the initial stage of advancement from the first station, said holding step including engaging the upper side of the fully grown first stack by a first jaw to thus separate the fully grown first stack from the growing second stack thereabove, engaging the second stack when fully grown from above by a second jaw, and lowering the second stack and the second jaw upon completed removal of the first stack from the first station.

2. The method of claim 1, wherein said gathering step includes maintaining successive stacks of the series in an orientation such that each stack has an underside and an upper side, said supporting step including contacting at least the major part of the underside and said engaging step by the first jaw including contacting a relatively small portion of the upper side of the stack which is being advanced from the first station.

3. The method of claim 1, wherein each stack which is to be advanced from the first station has an upper side and an underside and said advancing step includes moving successive stacks in a predetermined direction, said engaging step by the first jaw including engaging the leader of the upper side of the first stack at said first station, as considered in said direction.

4. The method of claim 1, wherein said gathering step further includes feeding sheets on top of the second fully grown stack, said engaging step by second jaw comprising separating the second fully grown stack from the growing third stack, said advancing step including transferring the first fully grown stack ahead of the second fully grown stack so that the first station is continuously occupied by at least one fully grown stack and a growing stack on top of the at least ne fully grown stack.

5. The method of claim 4, wherein said lowering step comprises lowering the growing third stack with the second fully grown stack and the second jaw upon completed advancement of the first fully grown stack so that the second fully grown stack descends at least close to the level theretofore occupied by the first stack.

6. The method of claim 1, wherein said supporting step includes engaging successive stacks of the series by at least one belt conveyor and said advancing step further comprises moving the conveyor with the stack thereon during a first stage and driving the conveyor during the next-following stage of advancement of a stack from the first to the second station, so that the conveyor then advances the stack thereon in a direction away from the first station.

7. The method of claim 1, further comprising the step of admitting a compressed gaseous fluid between successive stacks of said series to separate successive stacks from one another by cushions of gaseous fluid.

8. The method of claim 1, further comprising the steps of mechanically separating successive stacks of said series from each other, lowering successive stacks of said series to said first station, and terminating the mechanical separating step between a preceding stack and the next-following stack of said series when the preceding stack reaches the first station.

9. The method of claim 1, wherein said advancing step further includes pushing successive stacks of said series from the first station.

10. The method of claim 9, wherein each stack occupying said first station has a rear side facing away from the direction of advancement toward the second station and said pushing step includes applying pressure to the rear side of such stack.

11. Apparatus for accumulating and manipulating stacks of sheets, comprising means for gathering sheets into a series of stacks at a first station, including means for feeding stacks to the first station from above to form a first growing stack and a second growing stack on top of the first stack when the latter is fully grown; and means for advancing successive stacks of said series from the first station to a second station, including mobile means for supporting successive stacks of the series from below and means for holding successive stacks from above, at least during the initial stage of advancement of stacks from said first station, said holding means including a first jaw having an underside arranged to contact the upper side of the first fully grown stack at the first station, means for moving said first jaw between the first fully grown stack and the second growing stack at said first station so that the first jaw separates the topmost sheet of the first fully grown stack from the lowermost sheet of the growing second stack, a second jaw, means for moving the second jaw on top of the fully grown second stack, and means for lowering the second stack and the second jaw upon completed advancement of the first stack from the first station.

12. The apparatus of claim 11, wherein each stack at said first station has an upper side and an underside, said supporting means including means for contacting at least the major part of the underside of the stack at said first station and said first jaw including means for contacting a relatively small portion of the upper side of the stack at said first station.

13. The apparatus of claim,11, wherein said supporting means comprises at least one belt conveyor, a carriage for said conveyor and means for driving said conveyor relative to said carriage.

14. The apparatus of claim 13, further comprising means for driving said carriage and the conveyor relative to said stations.

15. The apparatus of claim 11, further comprising means for admitting a compressed gaseous fluid between successive stacks of said series to thereby segregate neighboring stacks from each other.

16. The apparatus of claim 11, further comprising means for mechanically separating the stack at said first station from the next- following stack of said series.

17. The apparatus of claim 11, wherein said advancing means includes a pusher.

18. The apparatus of claim 17, wherein each stack at first station has a side facing away from said second station and said pusher is actuatable to move the stack occupying said first station toward said second station by bearing against said side of the stack at the first station.

19. The apparatus of claim 11, wherein said advancing means includes means for advancing successive stacks of said series in a predetermined direction, the upper side of each stack at said first station having a leader as seen in said direction and said first jaw including means for contacting the leader of the upper side of the stack at the first station.

20. A method of accumulating and manipulating stacks of sheets, comprising the steps of gathering sheets into a series of stacks at a first station, including feeding sheets into the first station from above to form a first growing stack and a second growing stack on top of the first stack when the latter is fully grown, each fully grown stack having an upper side and said gathering step further including converting the second growing stack into a fully grown stack which is located on top of the fully grown first stack and has an upper side, and feeding sheets on top of the second fully grown stack; advancing successive stacks of the series of stacks from the first to a second station, including supporting successive stacks from below and holding successive stacks from above, at least during the initial stage of advancement from the first station, said holding step including engaging the upper side of the fully grown stack by at least one jaw to thus separate the fully grown stack from the growing stack thereabove, said holding step further comprising engaging the upper side of the second fully grown stack by at least one second jaw to thereby separate the second fully grown stack from the growing third stack and said advancing step further including transferring the first fully grown stack ahead of the second fully grown stack so that the first station is continuously occupied by at least one fully grown stack and a growing stack on top of the at least one fully grown stack; lowering the second fully grown stack, the at least one second jaw and the growing third stack upon completed advancement of the first fully grown stack so that the second fully grown stack descends at least close to the level theretofore occupied by the first stack; lifting the at least one jaw at least by the height of a fully grown stack upon at least partial completion of advancement of the first stack from the first station; and moving the at least one jaw into engagement with the upper side of the third stack upon completed conversion of the third stack into fully grown stack so that the at least one jaw separates the grown third stack from a fourth stack growing on top of the third stack.

21. The method of claim 20, wherein said advancing step further comprises advancing the fully grown second stack from the first station and further comprising the steps of lowering the third and fourth stacks with the at least one jaw, raising the at least one second jaw at least by the height of a fully grown stack upon at least partial completion of advancement of the second stack from the first station and moving the at least one second jaw into engagement with the upper side of the fourth stack upon completed conversion of the fourth stack into a fully grown stack so that the at least one second jaw separates the fully grown fourth stack from a fifth stack growing on top of the fourth stack, the at least one jaw and the at least one second jaw descending with alternate fully grown stacks and being raised above the upper sides of the respective fully grown stacks upon at least partial completion of advancement of such stacks from the first station.

22. A method of accumulating and manipulating stacks of sheets, comprising the steps of gathering sheets into a series of stacks at a first station; and advancing successive stacks of the series from the first to a second station, including supporting successive stacks from below and holding successive stacks from above, at least during the initial stage of advancement from the first station, said supporting step including engaging successive stacks of the series by at least one belt conveyor and said advancing step further comprising moving the conveyor with the stack thereon during a first stage and driving the conveyor during the next-following stage of advancement of a stack from the first to the second station, so that the conveyor then advances the stack thereon in a direction away from the first station, said moving step including mounting the conveyor on a reciprocable carriage and moving the carriage and the conveyor thereon in a predetermined direction to advance the stack on the conveyor from the first station, said driving step including moving the conveyor relative to the carriage during said next-following stage of advancement of the stack on the conveyor from the first station so that the conveyor moves the stack thereon relative to the carriage.

23. The method of claim 22, wherein said holding step includes engaging the stack on the conveyor with a jaw and moving the jaw with the stack at least during a portion of said first stage, and further comprising the step of thereupon lifting the jaw above and away from the stack on the conveyor.

24. The method of claim 22, further comprising the steps of lowering the next-following stack of said series to the level of the stack on the conveyor upon completed advancement of the stack on the conveyor from the first station, and moving the conveyor relative to the carriage counter to said predetermined direction to thereby return the conveyor to a starting position in which the conveyor engages the lowered stack.

25. The method of claim 24, further comprising the steps of supporting the next-following stack from below in the course of said lowering step.

26. The method of claim 25, wherein the step of supporting the next-following stack of the series includes contacting at least the major part of the underside of the next-following stack.

27. The method of claim 25, wherein the step of supporting the next-following stack includes placing beneath the next-following stack an air table and blowing air from the air table against the underside of the next-following stack.

28. The method of claim 27, wherein said placing step includes moving the table in said predetermined direction in synchronism with the conveyor during said next-following stage of advancement of the stack on the conveyor from said first station.

29. Apparatus for accumulating and manipulating stacks of sheets, comprising means for gathering sheets into a series of stacks at a first station; means for advancing successive stacks of said series from the first station to a second station, including mobile means for supporting successive stacks of the series from below and means, including at least one mobile jaw, for holding successive stacks from above, at least during the initial stage of advancement of stacks from said first station, said supporting means comprising at least one belt conveyor, a carriage for said conveyor and means for driving said conveyor relative to said carriage; means for driving said carriage and the conveyor relative to said stations; means for moving said jaw relative to said stations; and control means for said moving means and said driving means, including means for initiating disengagement of the jaw from the stack on said conveyor and thereupon a movement of the conveyor and of the stack thereon relative to said carriage while said carriage is in motion.

30. Apparatus for accumulating and manipulating stacks of sheets, comprising means for gathering sheets into a series of stacks at a first station; means for advancing successive stacks of said series from the first station to a second station, including mobile means for supporting successive stacks of the series from below and means for holding successive stacks from above, at least during the initial stage of advancement of stacks from said first station, said supporting means comprising at least one belt conveyor, a carriage for said conveyor and means for driving said conveyor relative to said carriage, said driving means including a plurality of pulleys including pulleys mounted on said carriage and at least one driven pulley; and means for braking at least one of said pulleys.

31. Apparatus for accumulating and manipulating stacks of sheets, comprising means for gathering sheets into a series of stacks at a first station; means for advancing successive stacks of said series from the first station to a second station, including mobile means for supporting successive stacks of the series from below and means for holding successive stacks from above, at least during the initial stage of advancement of stacks from said first station, said supporting means comprising at least one belt conveyor, a carriage for said conveyor and means for driving said conveyor relative to said carriage, said driving means including means for moving said conveyor and a stack on said conveyor in a first direction toward said second station and in a second direction counter to said first direction upon completed transfer of a stack from the conveyor; and means for lowering successive stacks of said series at said first station so that a fresh stack is located above said conveyor when the latter completes its movement in said second direction.

32. Apparatus for accumulating and manipulating stacks of sheets, comprising means for gathering sheets into a series of stacks at a first station; means for advancing successive stacks of said series from the first station to a second station, including mobile means for supporting successive stacks of the series from below and means for holding successive stacks from above, at least during the initial stage of advancement of stacks from said first station; and means for lowering successive stacks of said series at said first station including an air table having a plurality of port and means for supplying to said ports a compressed gaseous fluid so as to form a fluid cushion between said table and the stack thereon.

33. The apparatus of claim 32, wherein said supporting means comprises a carriage and further comprising drive means for moving said carriage in synchronism with said table to and from said first station so that the carriage is located at said first station beneath a preceding stack of said series when said table is remote from said first station and said table is located at said first station beneath the next-following stack of said series when the carriage is remote from said first station.

34. Apparatus for accumulating and manipulating stacks of sheets, comprising means for gathering sheets into a series of stacks at a first station, including means for feeding sheets to the first station from above to form a first growing stack and a second growing stack on top of the first stack when the latter is fully grown, each stack at said first station having an upper side and an underside; and means for advancing successive stacks of series from the first station to a second station, including mobile means for supporting successive stacks of the series from below and means for holding successive stacks from above, at least during the initial stage of advancement of stacks from said first station, said supporting means including means for contacting at least the major part of the underside of the stack at said first station, said holding means including at least one jaw having an underside arranged to contact a relatively small portion of the upper side of the stack at said first station, said advancing means further comprising means for moving said jaw between the fully grown stack and the growing stack at said first station so that the jaw separates the topmost sheet of the first stack from the lowermost sheet of the second stack, said moving means including means for lifting said jaw at least by the height of a fully grown stack upon completed advancement of the fully grown first stack from said first station.

35. Apparatus for accumulating and manipulating stacks of sheets, comprising means for gathering sheets into series of stacks at a first station, including means for feeding sheets to the first station from above to form a first growing stack and a second growing stack on top of the first stack when the latter is fully grown, each stack at said first station having an upper side and an underside and said feeding means further including means for forming a growing third stack on top of the second stack upon completed conversion of the second stack into a fully grown stack; and means for advancing successive stacks of said series from the first station to a second station, including mobile means for supporting successive stacks of the series from below and means for holding successive stacks from above, at least during the initial stage of advancement of stacks from said first station, said supporting means including means for contacting at least the major part of the underside of the stack at said first station, said holding means including at least one first jaw having an underside arranged to contact a relatively small portion of the upper side of the stack at said first station, said advancing means further comprising means for moving said first jaw between the fully grown stack and the growing stack at said first station so that the first jaw separates the topmost sheet of the first stack from the lowermost sheet of the second stack, said advancing means also comprising a second jaw and means for moving the second jaw between the fully grown second stack and the growing third stack so that the second jaw separates the topmost sheet of the second stack from the lowermost sheet of the third stack.

36. The apparatus of claim 35, further comprising means for lowering the fully grown second stack at the first station and said second jaw upon completed advancement of the fully grown first stack from the first station.

37. The apparatus of claim 35, wherein said moving means includes means for alternately raising and lowering each of said jaws and means for controlling said raising and lowering means so that one of said jaws descends with the topmost fully grown stack while the other of said jaws rises to engage the upper side of the next fully grown stack and the position of the jaw on top of a fully grown stack with reference to such stack remains unchanged until after the stack leaves said first station.

* * * * *